US005601069A

United States Patent [19]

Clark

[11] Patent Number: 5,601,069

[45] Date of Patent: Feb. 11, 1997

[54] RETRACTABLE ARROW REST

[76] Inventor: James F. Clark, Rte. 2, Box 19, Amity, Ark. 71921

[21] Appl. No.: 333,797

[22] Filed: Nov. 3, 1994

[51] Int. Cl.[6] ..... F41B 5/22

[52] U.S. Cl. ..... 124/44.5

[58] Field of Search ..... 124/23.1, 24.1, 124/44.5, 86, 88

[56] References Cited

U.S. PATENT DOCUMENTS

| | | | |
|---|---|---|---|
| 3,108,584 | 10/1963 | Coe | 124/44.6 |
| 3,342,173 | 9/1967 | Ferguson | 124/44.5 |
| 3,504,659 | 4/1970 | Babington | 124/44.5 X |
| 4,133,334 | 1/1979 | Tone | 124/44.5 |
| 4,287,868 | 9/1981 | Schiff | 124/44.5 |
| 4,344,409 | 8/1982 | Barner | 124/24.1 |
| 4,548,189 | 10/1985 | Pietraszek et al. | 124/44.5 |
| 4,579,101 | 4/1986 | Bateman, III | 124/44.5 |
| 4,732,135 | 3/1988 | Simo | 124/44.5 |
| 4,803,971 | 2/1989 | Fletcher | 124/44.5 |
| 4,809,669 | 3/1989 | Saunders | 124/24.1 |
| 4,907,566 | 3/1990 | Klein | 124/44.5 |
| 4,953,521 | 9/1990 | Troncoso et al. | 124/24.1 |
| 5,009,215 | 4/1991 | Ludwig | 124/44.5 |
| 5,150,700 | 9/1992 | Troncoso | 124/44.5 |
| 5,161,514 | 11/1992 | Cary | 124/24.1 |
| 5,213,090 | 5/1993 | Tone | 124/44.5 |
| 5,235,958 | 8/1993 | Laffin | 124/44.5 |
| 5,394,858 | 3/1995 | Karolian | 124/44.5 |

*Primary Examiner*—John A. Ricci
*Attorney, Agent, or Firm*—Raymond L. Greene

[57] ABSTRACT

A retractable arrow rest activated on the initial movement of an arrow is provided. The arrow rest has a retractable pin which is an articulated pin or alternatively a telescoping pin, having a spring-loaded retract mechanism. By moving the articulated pin to an extended overcenter position, the pin is locked to support an arrow. An adjustment on the pin permits setting the sensitivity of the pin to retracting. At the proper sensitivity level, the pin will immediately retract on the first movement of the arrow (well before fletching impact). An over arrow safety lock to prevent movement of the arrow out of the rest and to prevent retraction of the pin is also provided. The safety lock allows precise hair trigger settings on the retractable pin while preventing inadvertent retractions.

13 Claims, 7 Drawing Sheets

RETRACTABLE ARROW REST

FIELD OF THE INVENTION

The invention is related to the archery field and in particular to archery projectile rests.

BACKGROUND OF THE INVENTION

Early arrow rests included rests supported by notches to provide a guide as arrows are discharged from the bow. These arrow rests cause large inaccuracies in the trajectory of an arrow. It is well known in the art that an arrow undergoes a series of flexing and bowing motions upon release. In U.S. Pat. No. 5,213,090 to Tone, col 1, lines 31–57, it is documented that fletching strikes on an arrow rest can result in a dispersion of the arrows such that a shot group thirty inches in diameter is formed, whereas when fletching strikes are avoided, the same shot group falls within only a 6-inch circle. Arrow rests introduce undesirable vertical and horizontal forces to the arrow as the fletchings pass over the arrow rests. These undesirable vertical and horizontal forces cause both deflection of the arrow and damage to the fletchings. As noted in the prior art, slotted arrow rests which allow the fletchings to pass through the arrow rest are not suitable for most hunting arrows which have spiral fletching necessary to induce rotation during the flight of the arrow.

Retractable and moveable arrow rests have been introduced to allow the use of all types of fletchings while reducing deflection or damage to the arrow. There are various types of retractable or moveable arrow rests available. A first type includes those current state-of-the art arrow rests which fall in the category of pull down rests or fall down rests. Another type uses the recoil of the bow to move a small weight associated with a spring loaded device. The arrow rest is then forced down and out of the path of the fletching so as not to deflect the arrow from its intended path. This type of device usually must be cocked before each shot. A third type of device uses a string or other attachment to connect the arrow rest to the bow cable so that as the bow is drawn the device is pulled up into the shooting position and as the bow is released the slackening allows the arrow rest to fall out of the line of travel of the arrow. All of these devices have certain short comings due to reaction time of the mechanism. The movement of the arrow is sufficiently rapid that the fletching will strike a retractable rest mechanism even though it begins to fall on bow reaction or upon slackening of the strings. Only the positive pull down mechanism provides a means to assure that the rest will be sufficiently retracted by the time the fletching pass to avoid an impact. This type of rest retraction adds additional string and mechanism which can interfere with unencumbered and flexible use of the bow. There remains a need for an effective retractable arrow rest which will be clear of the arrow fletching prior to the passage of the fletchings. There is also a need for a simple device which does not encumber the bow, the bow string or the associated equipment.

SUMMARY OF THE INVENTION

Accordingly, it is an object of this invention to provide an arrow rest with a retractable rest which retracts on initial movement of the arrow.

It is another object of the invention to provide a retractable arrow rest which retracts on either vertical or horizontal movement of the arrow.

It is yet another object of the invention to provide an arrow rest which retracts prior to the time the fletching pass the arrow rest.

It is a further object of the invention to provide an arrow rest independent of both the reaction of the bow or the tension in the draw string.

It is an object of this invention to provide an arrow rest for an archer's bow which moves immediately clear of the projectile upon the initial forward, vertical and/or horizontal motion of the projectile.

Accordingly, a retractable arrow rest having a spring-loaded rest arm is provided. The articulated spring loaded arm is mounted on a block which bolts to the side of the bow. In one embodiment, an articulated pin has an overcenter mechanism so that, using a spring attached to either end of the articulated pin, the pin is held in the open position when moved overcenter. Movement of the articulated pin into the folding position causes the spring to act positively to fold the pin away from the flight of the arrow. At the rest end of the articulated pin, an arrow support is provided formed by a plastic washer or coil spring device.

In the present invention, the arrow rest can be adjusted to retract either from initial lateral motion or from the initial forward motion of the arrow. This action results in the immediate retraction of the arrow rest mechanism as soon as the arrow begins to move. The entire sequence is completed prior to time that the fletchings pass the rest. The present invention has a novel retraction mechanism in that neither the reaction of the bow, nor the movement of the bow string, nor impact of the fletchings is required to retract the arrow rest. In an alternate embodiment, the arrow rest uses a telescoping rest to support the arrow. This telescoping rest is also spring-loaded to the retracted position and is triggered by the same initial movement of the arrow. To preclude inadvertent triggering of the retraction mechanism in either embodiment, a positive locking safety mechanism is provided which prevents triggering of the retraction mechanism unless a thumb-operated safety is released.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
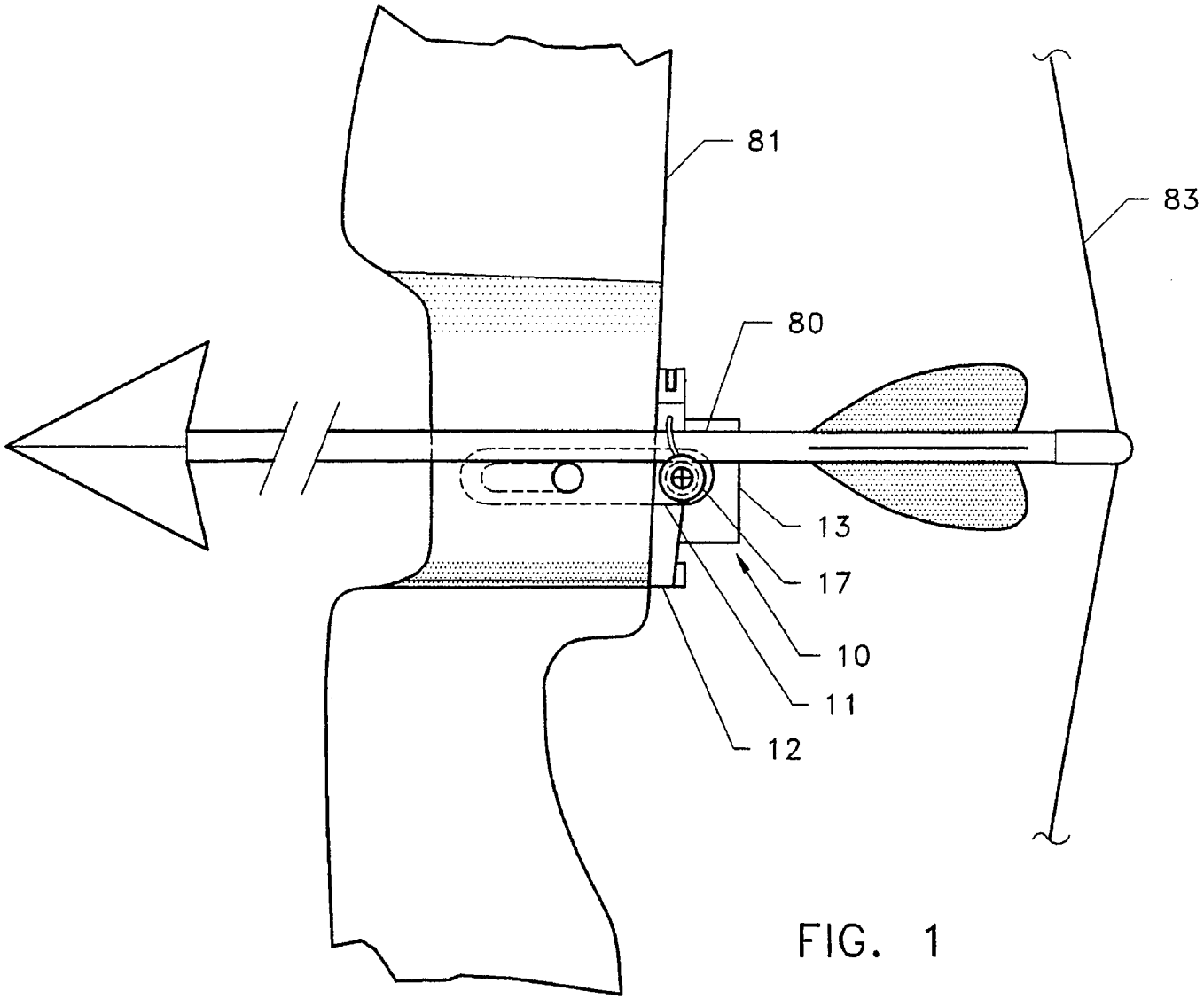
FIG. 1 is side view of the arrow rest attached to the bow.

Referring now to FIG. 1, the retractable arrow rest assembly of the present invention, designated generally by the reference numeral 10, is shown attached to a bow 81 and supporting an arrow 80 which is to be released from drawstring 83. Mounting block 11, which attaches the entire rest assembly 10 to bow 81, is comprised of two sub-blocks, 12 and 13. The arrow support 17 is attached to the operating end of the arrow rest mechanism and is shown in further detail in FIG. 2.

Figure 2:
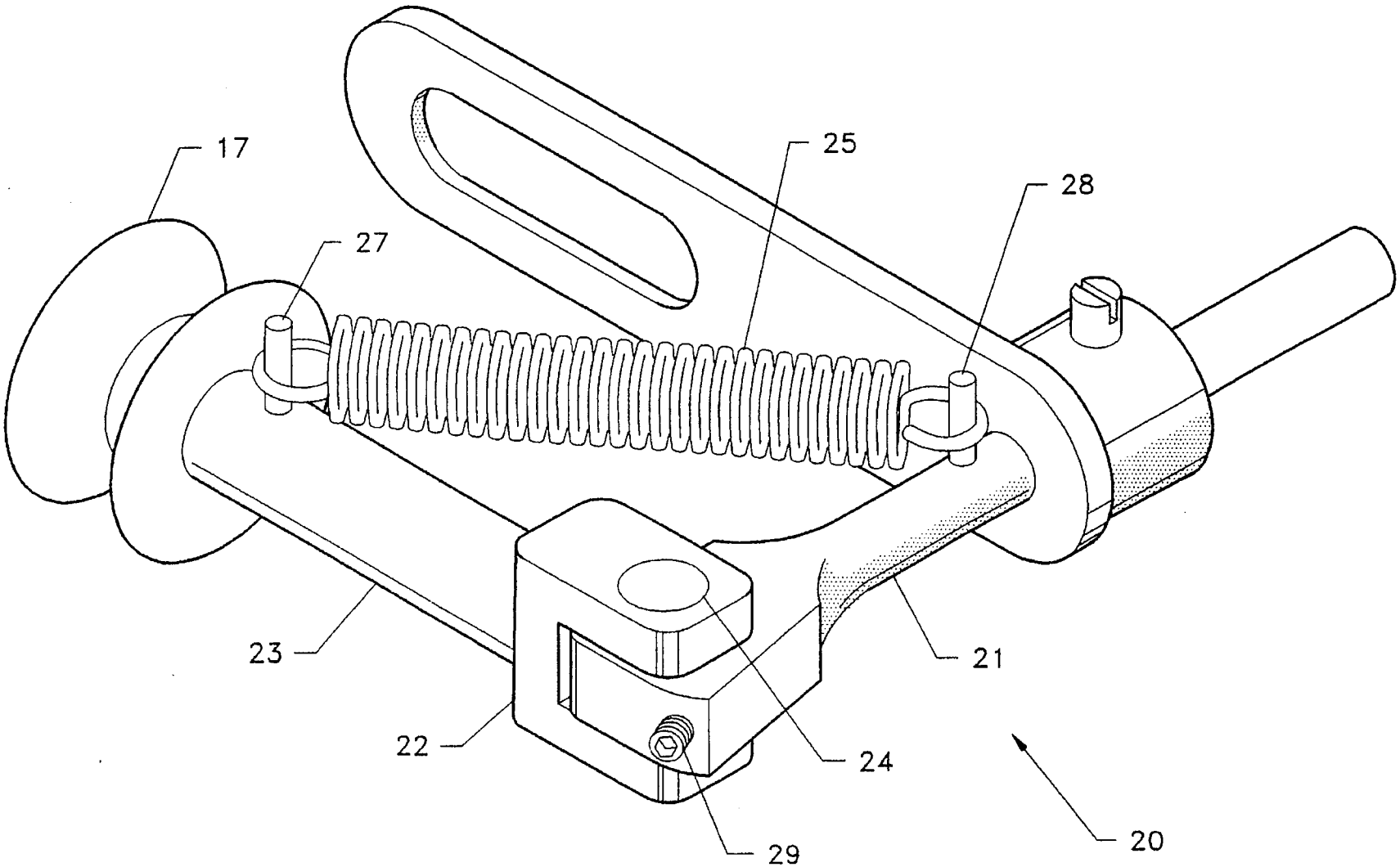
FIG. 2 is perspective view of the articulated pin mechanism in the folded position.

In one embodiment, the arrow support 17 is attached to articulated arm mechanism 20 as shown in FIG. 2. The articulated arm mechanism 20 has a fixed arm 21 and a moveable arm 23 rotatably secured together by pin 24. A retraction spring 25 snaps the moveable arm 23 and the arrow support 17 clear of the flight path of the arrow immediately upon the initial movement of the arrow 80. The retraction spring 25 is secured to spring anchor pin 27 and spring anchor pin 28 on moveable and fixed arms, respectively. An overcenter adjustment screw 29 protrudes against the inside edge of the U-shaped bracket 22 when the articulated arm 20 is in the extended position. By adjustment of this screw 29, it is possible to fine tune the triggering action of the rest. In practice, the screw is adjusted to maintain an extended position just overcenter and, with a correct tension in spring 25, the arm will snap out of the way of the arrow with the slightest movement of the arrow.

Figure 3:
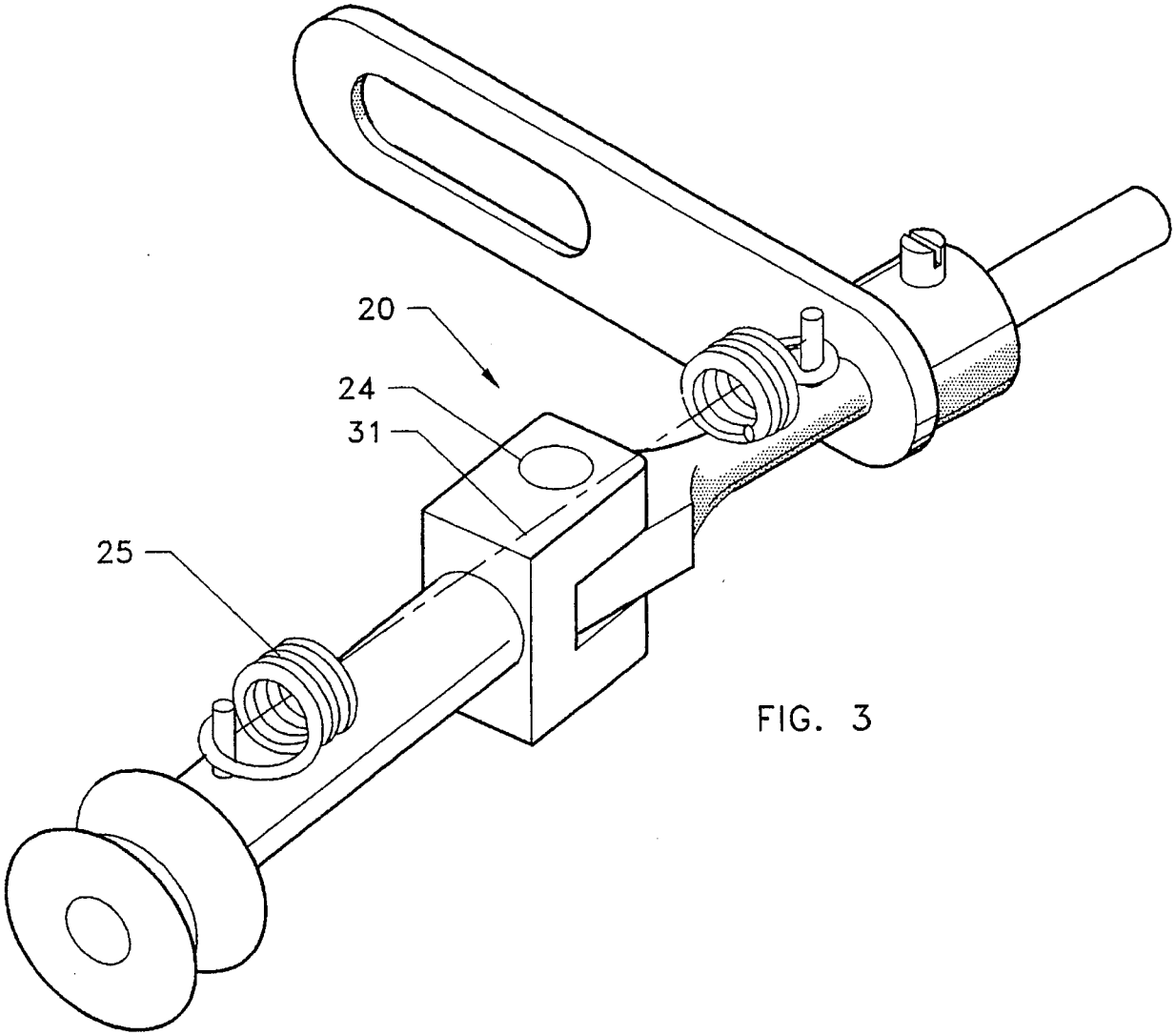
FIG. 3 is side view of articulated pin in the extended position.

Referring now to FIG. 3, (shown with part of spring 25 removed for improved clarity) articulated arm 20 is shown in the extended overcenter position. As may be seen by the spring line 31, the force of the spring 25 causes the articulated arm to remain in the extended position until the arm is moved slightly in the direction of the fold (in this configuration, forward in the direction of the arrow flight). The amount of overcentering is exaggerated in this drawing to show the mechanism. During actual use, the amount of overcenter is reduced by adjusting screw 29 (hidden in this Figure) so that the spring line is nearly coincident with the linear axis of the arm and passes almost over the center of pivot pin 24. When adjusted in the manner, the arm is hair-trigger sensitive, and will instantly retract with the slightest impetus. The use of the articulated arm with the forward folding action (as depicted), is a possible configuration for bow hunting. The articulated arm may also be rotated 90 degrees to provide for downward folding of the arm. This downward-folding configuration is most suitable for tournament shooting where there is a significant downward impetus to the arrow upon release. It is also possible to configure the bow with the arrow rest extending vertically upward to support the arrow and then folding forward and downward during arrow release.

Figure 4:
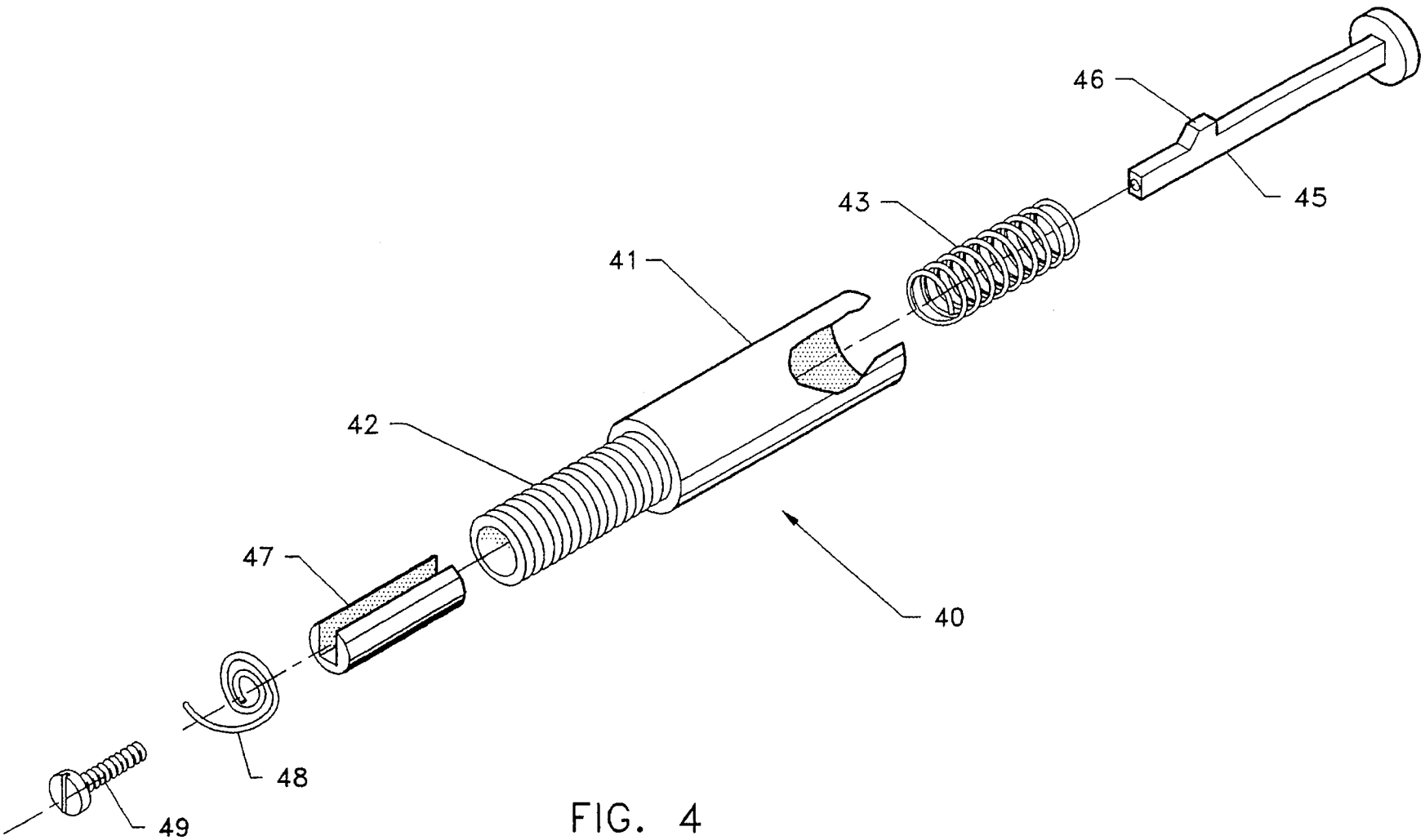
FIG. 4 is an exploded view of the alternate embodiment using a telescoping pin.

Referring now to FIG. 4, an alternate embodiment which includes a telescoping rest, designated generally by the reference numeral 40, is shown with its components. The telescoping rest 40 has a fixed outer tube 41 with a threaded end 42 for attachment to mounting block 11 shown in FIG. 1. A plunger spring mechanism is formed by spring 43 acting in conjunction with plunger shaft 45. Plunger shaft 45 has a locking nub 46 which catches on the rim of the threaded end of fixed outer tube 41. A plunger guide 47, an arrow support 48, and a machine screw 49 complete the telescoping rest.

Figure 5A:
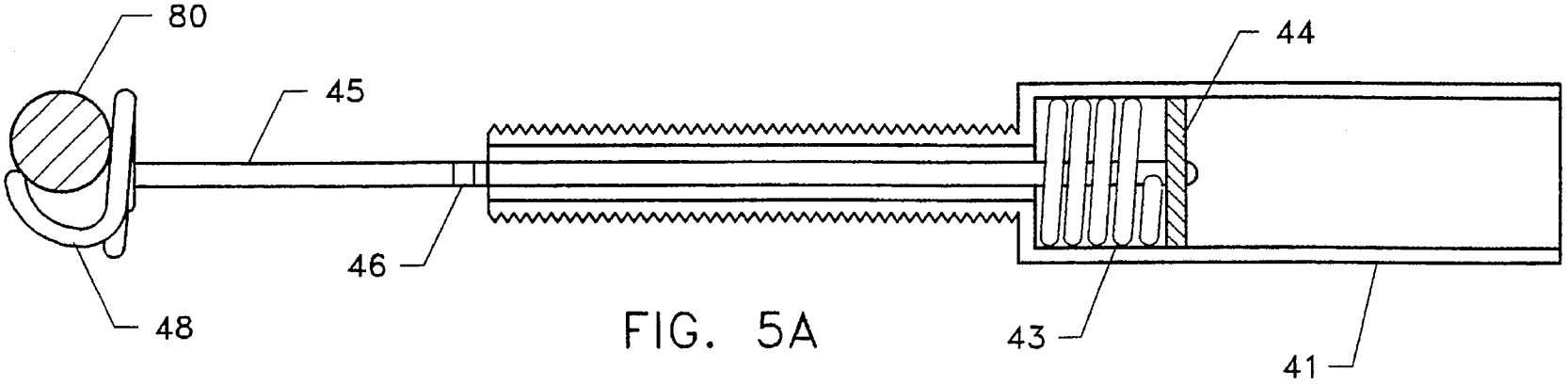
FIG. 5A is a side cross-sectional view of the telescoping pin in the extended position.
Figure 5B:
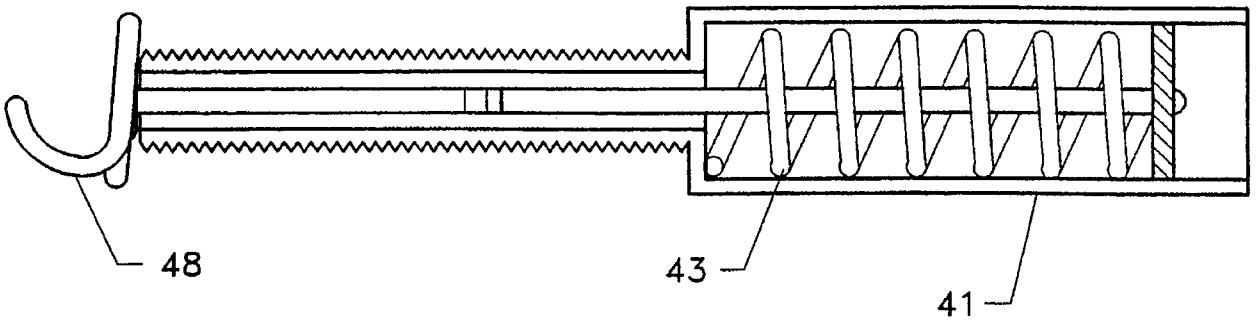
FIG. 5B is a side cross-sectional view of the telescoping pin in the retracted position.

FIGS. 5A and 5B show the telescoping rest in the extended and retracted positions, respectively. Retraction spring 43 is compressed in fixed outer tube 41 as shown in FIG. 5A when the arrow rest is extended and acts against washer 44 to provide a retraction force. For reference purpose, an arrow 80 is shown in arrow support 48 which is a wire coil in this embodiment. When locking nub 46 moves forward, the plunger 45 is released and moves into the retracted position as shown in FIG. 5B. These cross-sections are viewed looking forward from behind the bow.

Figure 6A:
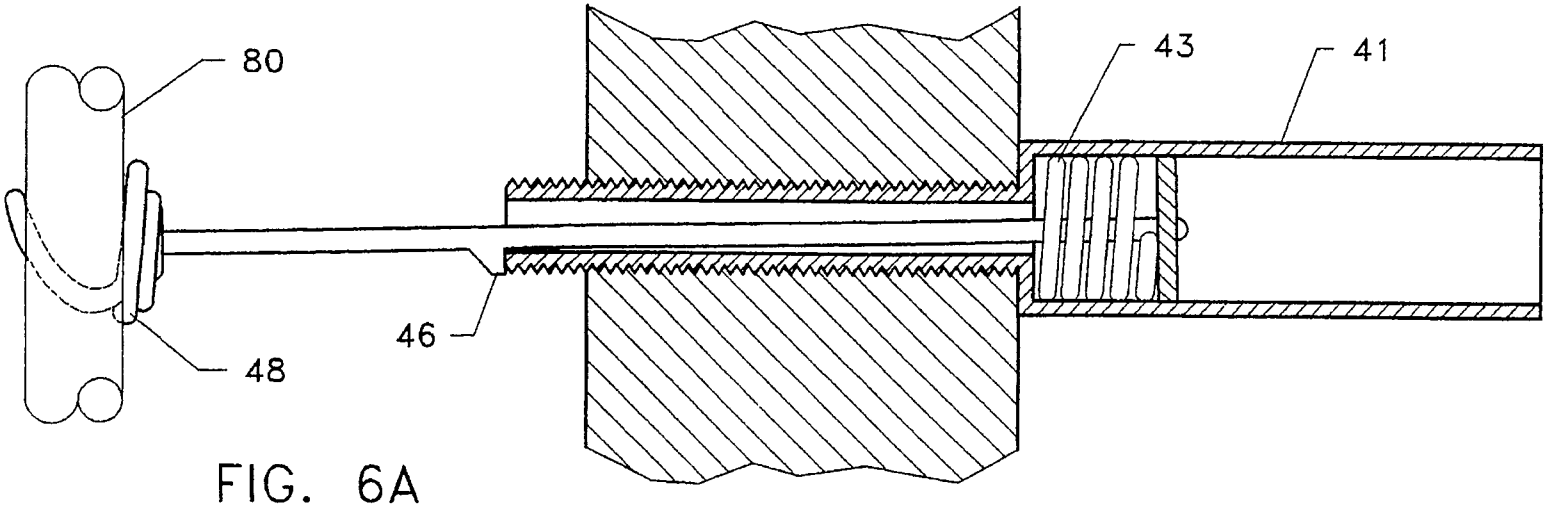
FIG. 6A is a top cross-sectional view of the telescoping pin in the extended position.
Figure 6B:
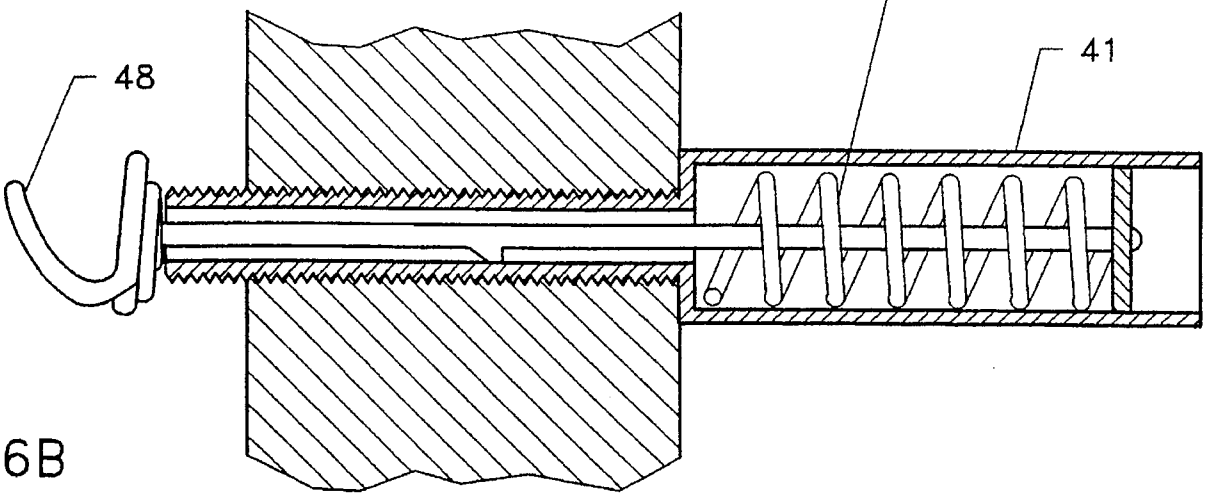
FIG. 6B is a top cross-sectional view of the telescoping pin in the retracted position.

Operation of the locking nub 46 may be seen as viewed looking down from the top in FIGS. 6A and 6B. Arrow 80 is supported by arrow support 48 with the retractable rest in the extended position. The locking nub 46 is moved off center, as shown in FIG. 6A, to keep the plunger mechanism extended. Compressed coil spring 43 provides a spring loaded retraction force inside outer fixed tube 41. FIG. 6B shows the rest after retraction. The initial movement of the arrow moves the plunger slightly forward causing the nub 46 to slip off the edge of tube 41 and then spring 43 drives the plunger to the fully retracted position. Although no adjustment is provided to change sensitivity in this configuration, it is possible to seat nub 46 more fully or less fully to the rear and thereby provide a small change in sensitivity.

Figure 7:
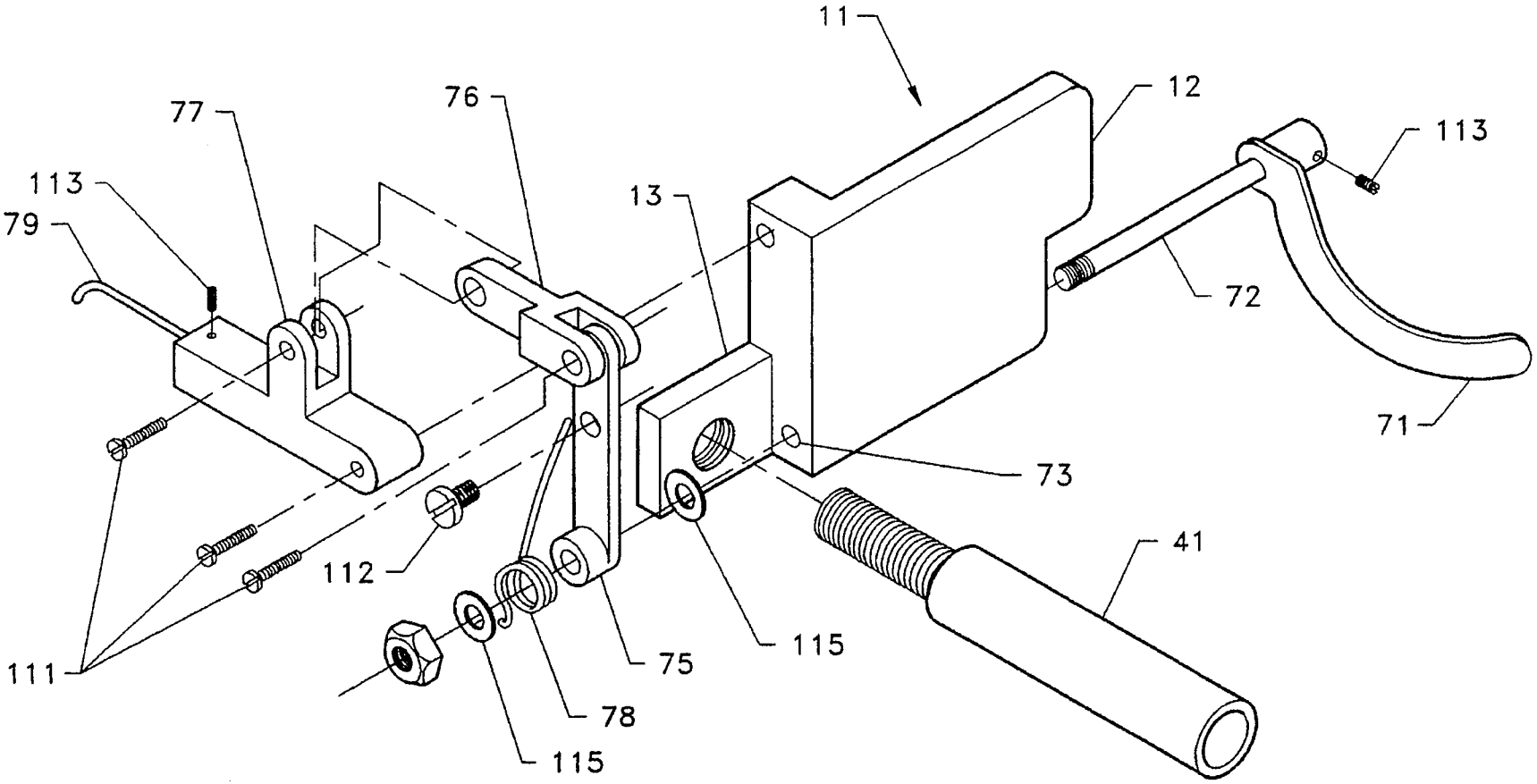
FIG. 7 is an exploded view of the arrow locking mechanism.

Because the retraction mechanism of this invention is highly sensitive and can be triggered very easily, the rest assembly also includes a safety locking assembly which locks the extended rests (for either embodiment) in the extended position and which also holds an arrow in position with respect to the arrow support. The locking mechanism is shown in greater detail in FIG. 7. Mounting block 11 is fabricated using two sub-blocks 12 and 13. Sub-block 13 provides a threaded aperture for attachment of the fixed part of the retractable arrow rest 41, shown in this embodiment with the telescoping rest mechanism. Sub-block 12 (which is welded to sub-block 13) is attached directly to a bow and serves as a mount for the safety locking mechanism. The lever-operated safety release assembly has a thumb-operated lever 71 attached to the first end of an actuating rod 72 which fits through a smooth bore aperture 73 in sub-block 12. Attached to a second end of actuating rod 72 is an articulated unlocking arm assembly comprising a first arm 75 which is rotatably connected to a drag link or second arm 76. The second arm is rotatably attached to a third rotating arm 77. The retaining pin assembly or third rotating arm 77 is pivotably attached to sub-block 12 and has a retaining pin 79 which lies over the arrow 80 and blocks any forward movement of the retractable rest mechanism. With the retaining pin 79 in the engaged position, the arrow 80 is held down against the arrow rest and the arrow support itself is held in the rearward position. In this configuration, which drawn or not, the bow may be jarred, handled, or moved around without any danger of triggering the rest to the retracted position. By depressing lever 71 just prior to arrow release, the retaining pin 79 is lifted well clear of the arrow and fletchings. Due to the gearing effect from the different lever lengths, only a small movement of lever 71 is required to rotate arm 77 through approximately 60 degrees of travel, thereby easily clearing the arrow path. The entire safety assembly is spring-loaded by spring 78 to the safe or engaged position. Other hardware items shown in the drawing are conventional fasteners, pivot pins 111, a spring retainer screw 112, set screws 113, and washers 115.

The features and advantage of the present invention are numerous. Because the mechanism of the arrow rest retracts on initial movement of the arrow (unlike prior art devices wherein the bow reaction, string slackening or actual fletching impacts trigger the retracting mechanism), no deflection of the arrow occurs. Additionally, the retractable mechanism of the present invention clears the arrow flight path prior to the time the fletchings pass the rest, thereby avoiding damage to the fletchings. Further, the retractable mechanism of this invention retracts on movement either in the vertical or the forward direction as selected by the archer. In the event of tournament shooting the mechanism may be adjusted for downward deflection of the rest because of the significant initial amount of downward movement of the arrow for tournament shooting.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

I claim:

1. An arrow rest assembly for a bow, comprising:

a mounting block attachable to the bow;

an arrow rest attached to the mounting block, said arrow rest including an arrow support attached to a shaft movable between extended and retracted positions, said arrow rest positioned such that when said shaft is in the extended position, the arrow support is in a position to support an arrow nocked on the bow, and when the shaft is in the retracted position, the arrow support is located a distance away from the arrow to allow unobstructed flight;

a retaining assembly for retaining said arrow on said arrow support and for maintaining said shaft in said extended position, comprising:

a manually operable lever rotatably affixed to said mounting block;

said manually operable lever including an actuating rod connected to an articulated arm assembly, said articulated arm assembly comprising a first arm rotatably connected to said mounting block, and a second arm rotatably connected to said first arm;

a retaining pin assembly rotatably affixed to said mounting block and also rotatably affixed to said second arm, said retaining pin assembly including a retaining pin, said retaining pin assembly manually movable between an engaged position in which said retaining pin contacts said arrow and firmly holds it onto said arrow support and prevents retraction of said arrow shaft, and a release position in which said retaining pin is out of contact with said arrow.

2. An arrow rest assembly as in claim 1 wherein said mounting block further comprises a first sub-block having a threaded aperture for receiving said arrow rest and a second sub-block affixed to the first sub-block, said second sub-block having a smooth bore aperture for receiving said actuating rod and a threaded aperture for attachment of said retaining pin assembly.

3. An arrow rest assembly as in claim 1 wherein said arrow rest comprises an articulated arm mechanism.

4. An arrow rest assembly as in claim 3 wherein said articulated arm mechanism comprises a fixed arm having an overcenter adjustment screw and having a spring anchor pin.

5. An arrow rest assembly as in claim 4 wherein said articulated arm mechanism further comprises a moveable arm rotatably attached to said fixed arm, said moveable arm having a spring anchor pin and having said arrow support attached thereto.

6. An arrow rest assembly as in claim 1 wherein said actuating rod has a first end and a second end.

7. An arrow rest assembly as in claim 6 wherein said manually operable lever is a thumb-operated lever attached to a first end of said actuating rod.

8. An arrow rest assembly as in claim 1 wherein said first arm includes a spring attached to the first arm spring-loading the retaining pin assembly into the engaged position.

9. An arrow rest assembly as in claim 1 wherein said arrow rest comprises a telescoping rest.

10. An arrow rest assembly as in claim 9 wherein said telescoping rest comprises a fixed outer tube threadably attached to said mounting block and having a plunger and spring mechanism contained within said fixed outer tube.

11. An arrow rest assembly as in claim 10 wherein said plunger and spring mechanism comprises a plunger shaft having a retaining washer engaging a coil spring which spring-loads the plunger into the retracted position, and said arrow support on a second end.

12. An arrow rest assembly as in claim 11 wherein said arrow support comprises a wire coil.

13. An arrow rest assembly as in claim 11 wherein said plunger shaft further comprises an off-center locking nub located along its length.

* * * * *